US009035204B2

(12) United States Patent
Czarnecki

(10) Patent No.: US 9,035,204 B2
(45) Date of Patent: May 19, 2015

(54) SWITCH ASSEMBLY WITH SEQUENTIALLY ACTUATED POWER AND NEUTRAL SWITCHING

(71) Applicant: Reliance Controls Corporation, Racine, WI (US)

(72) Inventor: Neil A. Czarnecki, Mt. Pleasant, WI (US)

(73) Assignee: Reliance Controls Corporation, Racine, WI (US)

( * ) Notice: Subject to any disclaimer, the term of this patent is extended or adjusted under 35 U.S.C. 154(b) by 160 days.

(21) Appl. No.: 13/775,602

(22) Filed: Feb. 25, 2013

(65) Prior Publication Data

US 2013/0220781 A1 Aug. 29, 2013

Related U.S. Application Data

(60) Provisional application No. 61/604,842, filed on Feb. 29, 2012.

(51) Int. Cl.

| | |
|---|---|
| ***H01H 9/26*** | (2006.01) |
| ***H01H 9/24*** | (2006.01) |
| ***H01H 11/00*** | (2006.01) |
| ***H01H 1/20*** | (2006.01) |
| ***H01H 23/16*** | (2006.01) |
| *H01H 23/20* | (2006.01) |
| *H01H 23/24* | (2006.01) |

(52) U.S. Cl.

CPC ..... *H01H 9/24* (2013.01); *H01H 11/00* (2013.01); *H01H 1/2016* (2013.01); *H01H 23/205* (2013.01); *H01H 23/24* (2013.01); *H01H 23/168* (2013.01); *H01H 2300/018* (2013.01)

(58) Field of Classification Search

CPC ... H01H 23/24; H01H 1/2025; H01H 1/2016; H01H 23/205; H01H 23/168

USPC ..... 200/1 B, 50.37, 553–560, 252, 257, 260, 200/9, 6 R

See application file for complete search history.

(56) References Cited

U.S. PATENT DOCUMENTS

| | | | | |
|---|---|---|---|---|
| 3,165,604 | A * | 1/1965 | Sorenson | 200/50.35 |
| 3,333,067 | A * | 7/1967 | Du Rocher et al. | 200/6 R |
| 3,936,782 | A | 2/1976 | Moakler et al. | |
| 3,949,336 | A | 4/1976 | Dietz | |
| 4,021,678 | A | 5/1977 | Moakler et al. | |
| 4,259,552 | A * | 3/1981 | Swann | 200/6 R |
| 4,398,097 | A | 8/1983 | Schell et al. | |
| 4,423,336 | A | 12/1983 | Iverson et al. | |
| 4,683,352 | A * | 7/1987 | Yano et al. | 200/6 R |
| 4,760,278 | A | 7/1988 | Thomson | |

(Continued)

*Primary Examiner* — Felix O Figueroa

(74) *Attorney, Agent, or Firm* — Boyle Fredrickson, S.C.

(57) ABSTRACT

A switch assembly and method of switching a load between a first power source and a second power source that maintains a desired sequencing of the making and breaking of both the neutral and power connections in response to a single user input. The switch assembly includes an actuator that is movable between a first position and a second position and a first movable element and a second movable element that are operably coupled to one another and the actuator. A positive switch contact arrangement is coupled with the first movable element and a neutral switch contact arrangement is coupled with the second movable element. The positive switch contact arrangement and the neutral switch contact arrangement comprise geometrically different constructions so that moving the actuator between the first position and the second position avoids an open neutral condition.

21 Claims, 7 Drawing Sheets

(56) References Cited

U.S. PATENT DOCUMENTS

| | | | | | |
|---|---|---|---|---|---|
| 4,780,580 | A | * | 10/1988 | Sawada | 200/438 |
| 4,803,317 | A | * | 2/1989 | Sutoh et al. | 200/438 |
| 4,904,833 | A | * | 2/1990 | Sato et al. | 200/557 |
| 4,978,823 | A | * | 12/1990 | Sato et al. | 200/553 |
| 5,070,252 | A | | 12/1991 | Castenschiold et al. | |
| 5,258,593 | A | * | 11/1993 | Hayakawa | 200/553 |
| 5,854,455 | A | * | 12/1998 | Cranick et al. | 200/6 R |
| 6,504,116 | B2 | * | 1/2003 | Nishikawa | 200/559 |
| 6,791,211 | B1 | | 9/2004 | Flegel | |
| 7,009,128 | B1 | | 3/2006 | Czarnecki et al. | |
| 7,060,920 | B2 | * | 6/2006 | Serizawa et al. | 200/5 R |
| 7,126,068 | B2 | | 10/2006 | Fillppenko | |
| 7,238,898 | B1 | | 7/2007 | Czarnecki | |
| 7,336,003 | B2 | | 2/2008 | Lathrop et al. | |
| 7,435,920 | B1 | | 10/2008 | Yoo | |
| 7,446,270 | B2 | | 11/2008 | Somalingayya et al. | |
| 7,446,437 | B2 | | 11/2008 | Paik et al. | |
| 7,462,791 | B1 | | 12/2008 | Flegel | |
| 7,531,762 | B2 | | 5/2009 | Flegel | |
| 7,557,683 | B1 | | 7/2009 | Wang | |
| 7,616,432 | B2 | | 11/2009 | Luebke et al. | |
| 7,781,919 | B2 | | 8/2010 | Black et al. | |
| 7,834,282 | B2 | | 11/2010 | Flegel | |
| 7,973,253 | B2 | | 7/2011 | Gibbs et al. | |
| 8,030,799 | B1 | | 10/2011 | Flegel | |
| 8,040,663 | B1 | | 10/2011 | Czarnecki | |
| 8,098,465 | B1 | | 1/2012 | Flegel | |
| 2006/0221533 | A1 | | 10/2006 | Lathrop et al. | |
| 2007/0278071 | A1 | | 12/2007 | Flegel | |
| 2009/0084664 | A1 | | 4/2009 | Flegel | |
| 2010/0038966 | A1 | | 2/2010 | Espeut, Jr. | |
| 2010/0140061 | A1 | | 6/2010 | Gibbs et al. | |
| 2010/0187075 | A1 | | 7/2010 | Flegel | |
| 2011/0100787 | A1 | | 5/2011 | Czarnecki et al. | |

* cited by examiner

SWITCH ASSEMBLY WITH SEQUENTIALLY ACTUATED POWER AND NEUTRAL SWITCHING

CROSS-REFERENCE TO RELATED APPLICATIONS

This application claims priority to U.S. Provisional Patent Application Ser. No. 61/604,842, filed on Feb. 29, 2012, titled "Sequentially Actuated Power And Neutral Switch" and the entire contents of which are expressly incorporated herein.

BACKGROUND AND SUMMARY OF THE INVENTION

The present invention relates to a switch assembly for switching between power sources, such as between utility power and an auxiliary power source such as, for example, a backup power source such as a gasoline or other combustible fuel powered generator. The switch is configured to prevent the occurrence of open-neutral configurations that present the potential for high-voltages, e.g., 240 VAC, to be erroneously applied to 120 VAC equipment or appliances, which may cause damage to the equipment or appliances.

Electrical panels, breaker boxes, or load centers frequently include a main contactor, switch, or breaker, which electrically isolates a series of load breakers from a utility power input. Certain types of load centers, such as transfer switches or transfer panels, are configured to receive another input power source, such as from a generator, to provide electrical power to selected individual loads in the event of a utility power failure. During interruption of utility power, the generator supplies power to the load center, which the load center distributes to the selected or designated circuits of the building. Before activating the generator power supply, the main switch must be disconnected or turned "OFF" to prevent the generator power from back-feeding through the utility conductors. Typically, a user must then manually configure one or more of the switches associated with the load center to electrically connect the desired load circuits to the generator power and electrically isolate the sources associated with the utility and generator power signals.

In order to maintain electrical isolation between the generator power input and the utility power input, the connection/disconnection of the utility power supply and generator power supply must be performed in a specific sequence to ensure electrical isolation of the respective power input sources. Various interlock and switching systems have been developed for carrying out this function. One such system is shown and described in Flegel U.S. Pat. No. 6,621,689 issued Sep. 16, 2003, and the disclosure of which is hereby incorporated by reference in its entirety. While the system shown in the '689 patent controls operation of a main power supply ON/OFF switch and an auxiliary power supply ON/OFF switch, it contains no provisions for controlling operation of neutral switches associated with the main or utility power supply, the auxiliary power supply, and the respective load circuits that are configured to be discretely powered by one of the respective power sources. Still other systems provide discrete switch arrangements wherein operation of individual actuators is associated with the conducting state of the discrete conductor circuits associated with a single conductor.

Proper sequencing of the various conducting states of the neutral and power or "hot" leads associated with the respective loads and alternate power sources is a significant issue when switching both the power (hot) and neutral conductors in power transfer equipment. Failure to break the neutral conductor connection last and make the neutral conductor connection first during the power source switching event results in an open neutral configuration that has the potential to allow high voltages (as much as 240 VAC) to be applied to 120 VAC appliances. It should be readily appreciated that providing voltages that are considerably greater than the voltage for which a particular appliance is rated has various undesirable effects, the least of which is the potential damage to those appliances so subjected. Unfortunately, many prior art devices fail to address such occurrences or require complex switching sequences that could be inadvertently incorrectly performed by users during power source switching activities without proper switch interlock constructions. Unfortunately, providing various switch interlock arrangements tends to complicate the power source switching operation and can increase the cost associated with forming a desired interlocking arrangement.

Therefore, there is a need for a single switch assembly that switches both the hot and neutral wire associated with a given circuit and does so in a manner that both first terminates or breaks the neutral connection associated with the circuit and a first power source and establishes a neutral connection of the circuit with a supplemental or second power source prior to connection of the power conductor with the supplemental power source circuit.

For the above reasons, it is desirable to provide a switch assembly that ensures electrical isolation of the utility power and the generator power during a transfer of the input power from one source to another, and which controls the sequence of operation of neutral and power connection to circuits associated with the utility and generator power supplies. The present invention discloses a switch assembly and method of switching connection of a load to alternate power sources that overcomes one or more of the drawbacks mentioned above. Representatively, the switch assembly includes a single actuator that, when engaged by the user, effectuates the desired sequencing of making and breaking the power and neutral connections between the load circuit and the alternate power sources.

Therefore, a first aspect of the invention contemplates a switch assembly that includes an actuator that is movable between a first position and a second position. The switch assembly includes a first movable element and a second movable element that are operably coupled to one another and the actuator. A positive switch contact arrangement is coupled with the first movable element and a neutral switch contact arrangement is coupled with the second movable element. The positive switch contact arrangement and the neutral switch contact arrangement comprise geometrically different constructions so that moving the actuator between a first position and a second position avoids an open neutral condition.

Another aspect of the invention contemplates a switch assembly having a first neutral contact, a second neutral contact, a first power contact, and a second power contact. The assembly includes a neutral conductor that is movable between a first position in which the neutral conductor is electrically connected to the first neutral contact and is electrically isolated from the second neutral contact and a second position in which the neutral conductor is electrically connected to the second neutral contact and is electrically isolated from the first neutral contact. The power conductor is movable between a first position in which the power conductor is electrically connected to the first power contact and is electrically isolated from the second power contact and a second position in which the power conductor is electrically connected to the second power contact and is electrically isolated from the second power contact. A single actuator effectuates sequential movement of the neutral conductor and the power conductor between their respective first and second positions, such that the neutral conductor remains in its first position after the power conductor moves from its first position, and arrives at its second position before the power conductor arrives at its second position.

Another aspect of the invention that is useable or combinable with one or more of the aspects above contemplates a method of switching a load between a first power source and a second power source. The method includes providing an actuator having a first portion and a second portion. The first portion of the actuator is shaped for cooperation with a neutral conductor that is selectively electrically connectable to one of a first neutral contact and a second neutral contact and is not electrically isolatable from a third neutral contact. The second portion of the actuator is shaped for cooperation with a power conductor that is selectively electrically connectable to one of a first power contact and a second power contact and is not electrically isolatable from a third power contact. The actuator is positionally associated relative to the neutral conductor and the power conductor so that movement of the actuator from a first position to a second position both 1) electrically isolates the neutral conductor from each of the first neutral contact and the second neutral contact before the power conductor is electrically isolated from a respective one of the first power contact and the second power contact and 2) electrically connects the neutral conductor to one of the first neutral contact and the second neutral contact before the power conductor is electrically connected to the other respective one of the first power contact and the second power contact. Such operation prevents open neutral and over power conditions in the underlying circuits and does so in a manner that requires only limited user interaction with the switch assembly to effectuate the desired switching of the load between the first and second power sources.

These and various other features, aspects, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION

Figure 1:
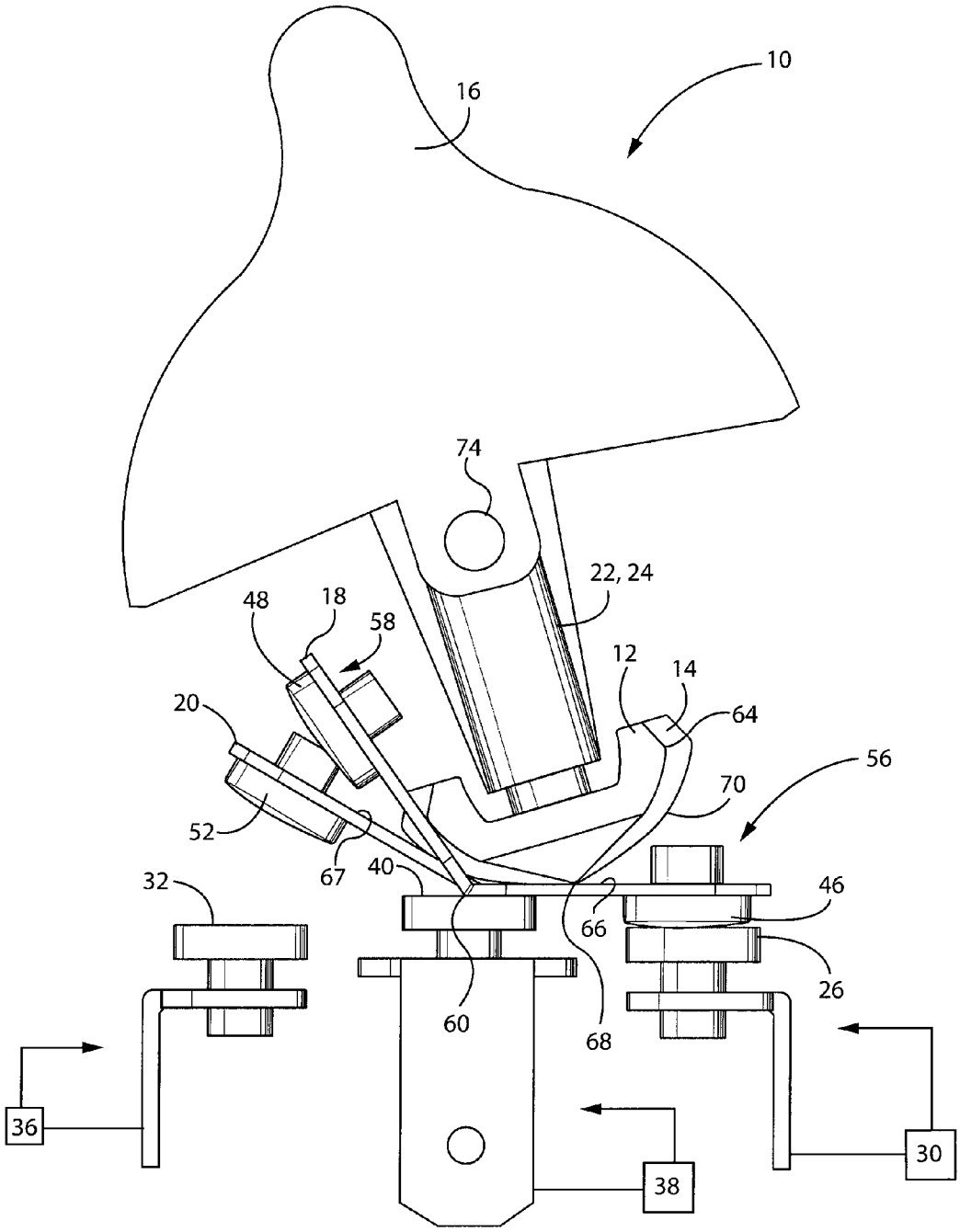
FIG. 1 depicts an elevation view of a switch assembly according to the present invention with the movable parts of the switch assembly in a first configuration.
Figure 2:
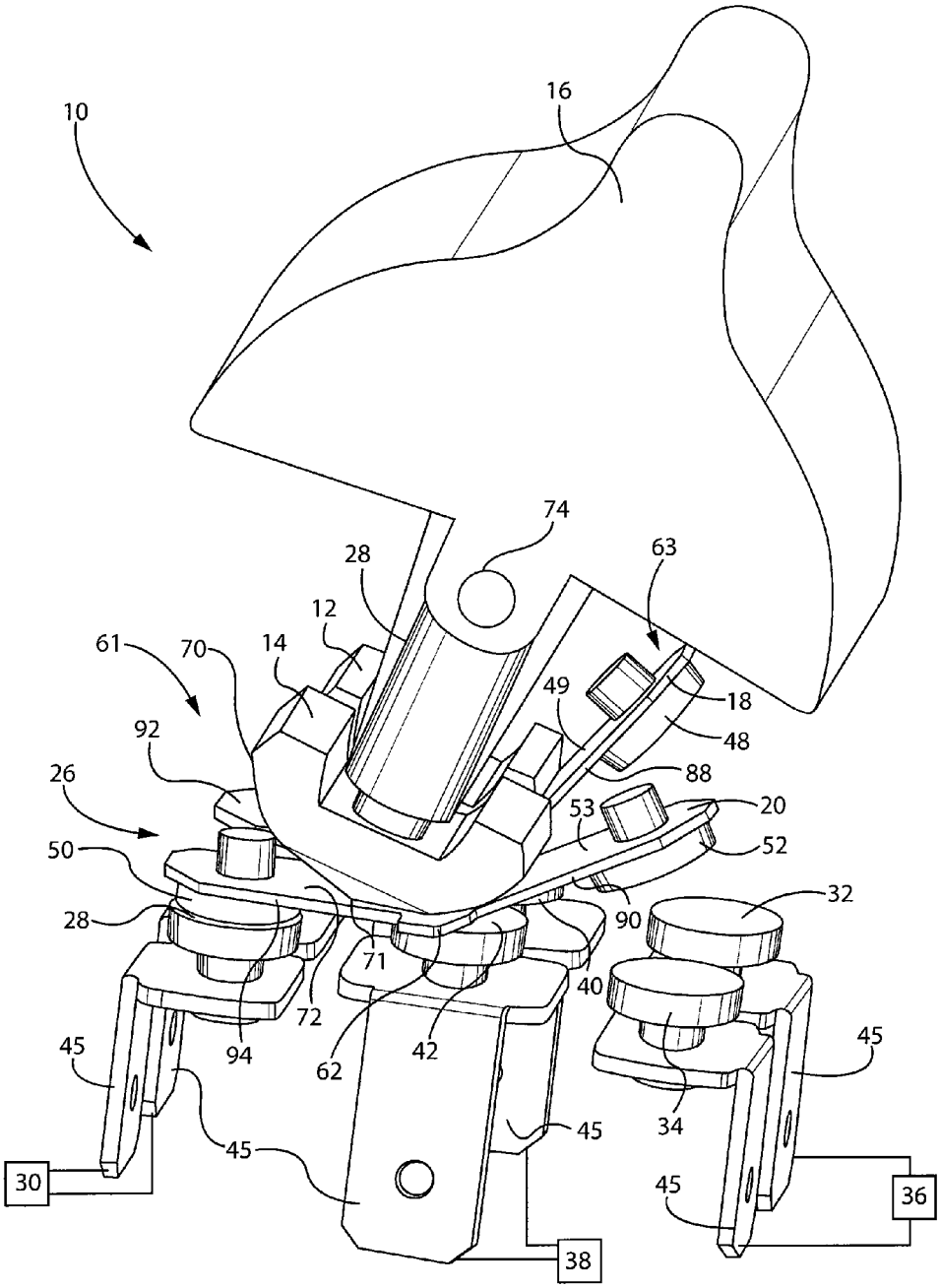
FIG. 2 depicts a perspective view of the switch assembly shown in FIG. 1 from an opposite lateral side of the assembly but still in the first configuration.

FIGS. 1-7 show a rocker-type switch or switch assembly 10 according to a representative embodiment of the present invention. Referring to FIGS. 1 and 2, switch assembly 10 includes a first control member or first movable element 12 and a second control member or second movable element 14 that are operably coupled to one another via a movable actuator 16 of the switch assembly 10. The switch assembly 10 may be in the form of a single-pole, double-throw switch assembly or any other such type of switch generally known in the art. As will be discussed in further detail, the first and second movable elements 12 and 14 are constructed so as to be geometrically different from one another but connected so as to be movable together.

As explained further below, the geometrical differences between movable elements 12, 14 result in the ability of one of the movable elements to make an electrical connection with a respective portion of a circuit associated with the respective movable element before making of an electrical connection associated with the other movable element, and conversely to break the electrical connection associated with the same circuit before making of the electrical connection associated with the respective portion of the circuit associated with the other movable element. In this manner, the particular construction of movable elements 12, 14 results in a switch assembly 10 that operates in a predetermined electrical connection sequence without requiring additional interaction by the operator with the switch assembly or supplemental interlocking structures. That is, the operator need only carry out a single switching action, i.e., movement of an actuator associated with the switch assembly between relative positions, to guarantee proper sequencing of the making and breaking of the electrical connections associated with a circuit.

Still referring to FIGS. 1 and 2, user manipulation of actuator 16 controls movement of movable elements 12 and 14 via translation of respective rockers or power and neutral conductors 18, 20 relative to the respective movable elements 12, 14. Elements 12, 14 can be configured in the form of outwardly biased plungers that cooperate with or are received in corresponding cylindrical receivers 22, 24 associated with actuator 16. Alternatively, it is appreciated that elements 12, 14 can be integrally formed with actuator 16. Elements 12, 14 are representatively disposed normal to an upper surface 66, 67 of the respective movable power and neutral conductors 18, 20 so that movable elements 12, 14 translate relative to the respective power and neutral conductors 18, 20 and effectuate rotation or rocking movement of each of conductors 18, 20 relative to at least two power contacts and at least two neutral contacts associated with an underlying circuit to effectuate making and breaking of an electrical connection between a circuit associated with a load and the respective neutral and power contacts associated with alternate power sources.

As shown schematically in FIGS. 1 and 2, in which it should be noted that the views shown respectively therein are from opposite lateral sides of the switch assembly 10 or from sides of the switch assembly that are generally normal to a plane of operation of actuator 16, switch assembly 10 is configured to selectively cooperate with a power contact 26 and a neutral contact 28 associated with a first power source 30—such as a utility power source. Switch assembly 10 is also configured to selectively cooperate with a power contact 32 and neutral contact 34 associated with a second power source 36—such as an auxiliary power source such as a generator. For reasons set forth below, it is appreciated that the orientations of power sources 30, 36 could be reversed relative to switch assembly such that power source 30 could be associated with a generator power and power source 36 could be associated with a utility or other alternate power source. For brevity, power sources 30, 36 are periodically referred to below simply as alternate power sources.

An applicable load circuit or simply load 38 is schematically indicated and can be electrically connected to the alternate power sources 30, 36 via a power contact 40 and a neutral contact 42 that are in electrical engagement with power conductor 18 and neutral conductor 20, respectively. It should be appreciated that portions of the electrical connections between power source 30, power source 36, and load 38 shown in FIG. 1 are shown as incomplete in as much as the neutral contacts 28, 34, 42 associated with power sources 30, 36 and load 38, respectively, are hidden from view as falling within the lateral footprint associated with power contacts 26, 32, 40 when viewed from the perspective shown in FIG. 1. It is however appreciated that various neutral and power contacts could be provided in other relative positions such that the respective power and neutral contacts associated with power sources 30, 36 and load 38 do not otherwise directly overlie one another when viewed from any particular vantage. It is further appreciated that each of contacts 26, 28, 32, 34, 40, 42 can include a stab 45 for electrically connecting each of the respective contacts with the desired portion of a respective circuit associated with power sources 30, 36 and load 38. Representatively, stabs 45 are constructed to allow tool-less engagement and removal of switch assembly 10 with the underlying circuit structures. It is further appreciated that contacts 26, 28, 32, 34, 40, 42 can be referred to as stationary contacts as the various contacts are commonly positionally fixed relative to one another and the underlying circuits associated with power sources 30, 36 and load 38.

Regardless of the relative orientations of the various power and neutral fixed position contacts, power conductor 18 includes a first movable contact 46 and a second movable contact 48 that are supported by a body 49 of power conductor 18. Neutral conductor 20 includes a first movable neutral contact 50 and a second movable neutral contact 52 that are supported by a body 53 of neutral conductor 20. Contacts 46, 48, 50, 52 are positionally fixed with respect to a respective conductor 18, 20 but are described as being movable due to the various relative positional associations of contacts 46, 48, 50, 52 with respect to contacts 26, 28, 32, 34 as a function of the relative orientation of the respective conductors 18, 20 relative to the corresponding respective contacts 46, 48, 50, 52 of switch assembly 10 associated with power sources 30, 36 and load 38.

Power contacts 46, 48 are disposed proximate generally opposite ends 56, 58 of body 53 and offset from a center portion or apex 60 formed along the longitudinal axis of body 53 of power conductor 18. In a similar manner, neutral contacts 50, 52 are disposed proximate generally opposite ends 61, 63 of body 49 and offset from a center portion or apex 62 of neutral conductor 20. Apex 60 of power conductor 18 is located proximate power contact 40 associated with load 38 whereas apex 62 of neutral conductor 20 is located proximate neutral contact 42 associated with load 38.

Still referring to FIGS. 1 and 2, movable element 12 includes an exterior surface 64 that is shaped to slidably cooperate with an upper surface 66 of power conductor 18. An apex 68 associated with surface 64 of movable element 12 slidably cooperates with upper surface 66 of power conductor 18 to effectuate rotation of power conductor 18 about apex 60 thereof. In a similar manner, movable element 14 includes an exterior surface 70 that includes an apex 71 that is shaped to slidably cooperate with an upper surface 72 of neutral conductor 20 to effectuate rotation of neutral conductor 20 relative to apex 62 thereof.

Figure 3:
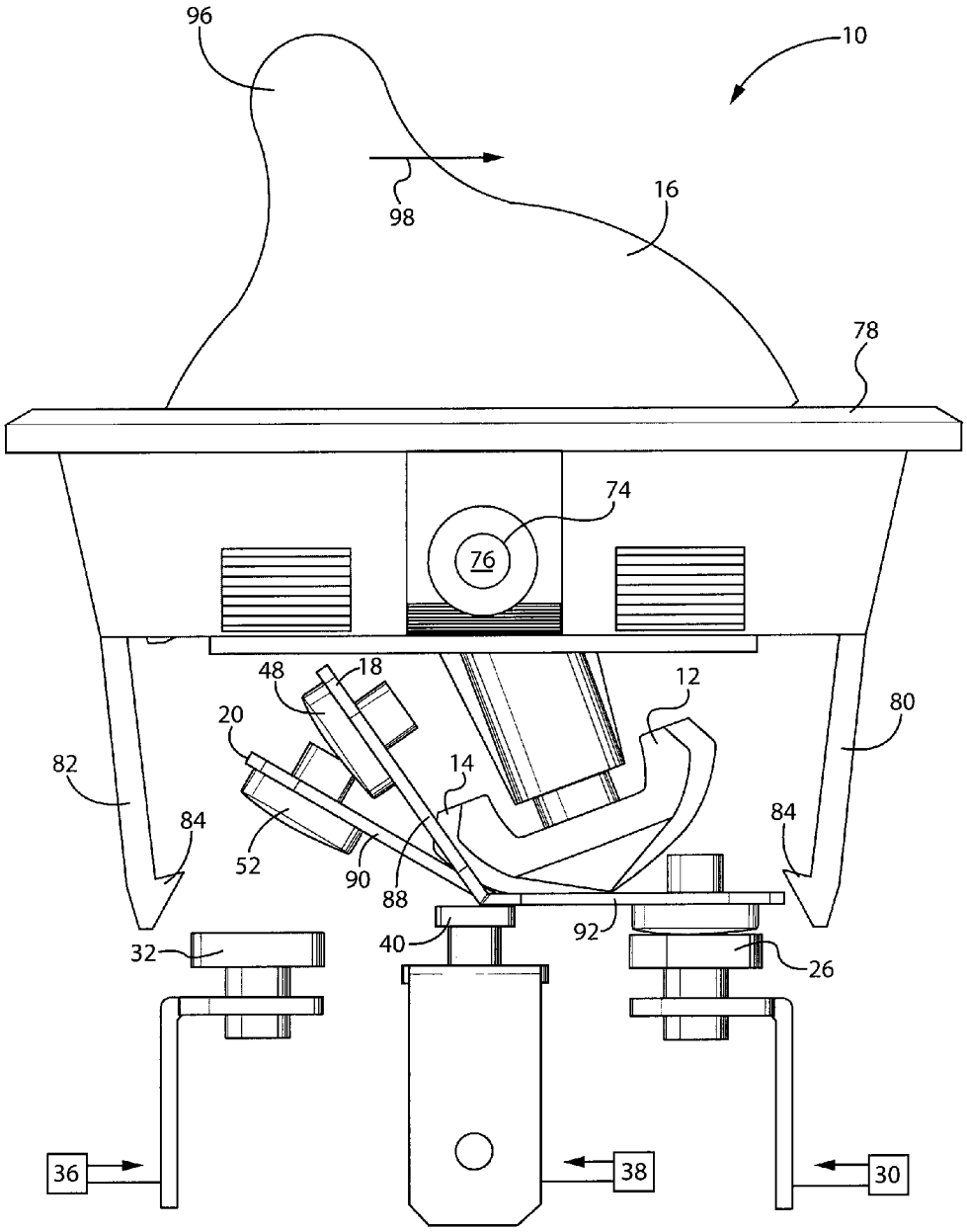
FIG. 3 depicts a view similar to FIG. 1 and shows a housing of the switch assembly, with the switch assembly in the first configuration wherein both the power and neutral conductors of a load are electrically connected to the power and neutral conductors associate with a first power source.

Referring to FIGS. 1-3, actuator 16 defines a pivot axis 74 constructed to cooperate with a pivot pin 76 that extends along pivot axis 74 and cooperates with a housing 78. Housing 78 includes one or more tangs 80, 82 that each include a catch 84 for securing housing 78, and the actuator 16 supported thereby, relative to the remainder of switch assembly 10. When engaged therewith, movable elements 12, 14 bias the contacts 46, 48, 50, 52, supported by power and neutral conductors 18, 20, into respective alternate engagements with contacts 26, 28, 32, 34, 40, 42 of switch assembly 10 in the manner described further below.

Bodies 49, 53 of power conductor 18 and neutral conductor 20 each have a generally bent shape that is defined by a first section or portion 88, 90 and a second section or portion 92, 94 that extend in generally opposite directions relative to the apex 60, 62 associated with the respective power and neutral conductor 18, 20. Power and neutral conductors 18, 20 may have generally V or U-shaped cross-sections or may form other shapes to allow isolated interaction of the respective contacts of conductors 18, 20 with the underlying contacts 26, 28, 32, 34. It is further appreciated that conductors 18, 20 need not have the same or similar bent shapes. For instance, conductor 18 may be shaped to define a generally U-shape and conductor 20 may be shaped to define a generally V-shape, or vice versa.

Regardless of their specific shape, conductors 18, 20 have geometrically different shapes, in that the shape of neutral conductor 20 is defined by a shallower bend angle than a bend angle associated with power conductor 18. Surface 64 of first movable element 12 defines a generally V or U-shaped actuation surface that generally matches the bend angle of power conductor 18 and surface 70 of second movable element 14 defines a shallower V or U-shaped actuation surface that generally matches the bend angle of neutral conductor 20. As used herein, it is appreciated that surfaces 64, 70 need not exactly match the shape of conductors 18, 20, respectively, but can be shaped to generally match of the shape of the respective power and neutral conductor 18, 20 to effectuate the desired motion of the respective conductors 18, 20 in response to movement of the respective movable elements 12, 14 relative thereto.

FIGS. 1-3 show switch assembly 10 in a first position, configuration, or orientation in which an end or handle 96 of actuator 16 is in a first position and movable elements 12, 14 are in a first position relative to power and neutral conductors 18, 20. Referring to FIGS. 2 and 3, from this orientation, it should be appreciated that power conductor 18 is electrically connected to power contact 26 associated with power source 30 as well as load power contact 42 whereas contact 48 of power conductor 18 is electrically isolated from the power contact 32 associated with the alternate power source 36. In a similar manner, as shown best in FIG. 2, when actuator 16 is in the first position, neutral conductor 20 is electrically connected to neutral contact 28 associated with power source 30 and load neutral contact 42, and contact 52 of neutral conductor 20 is electrically isolated from neutral contact 34 associated with the alternate power source 36. Said another way, when actuator 16 is in a first position, switch assembly 10 electrically connects a neutral portion and a power or hot portion of a circuit associated with a load 38 to a neutral portion and power or hot portion of a circuit associated with first power source 30, and also maintains an electrical isolation of power and neutral conductors 18, 20 from the neutral portion and power portion associated with alternate power source 36 and from the other conducting structures associated with switch assembly 10.

Figure 4:
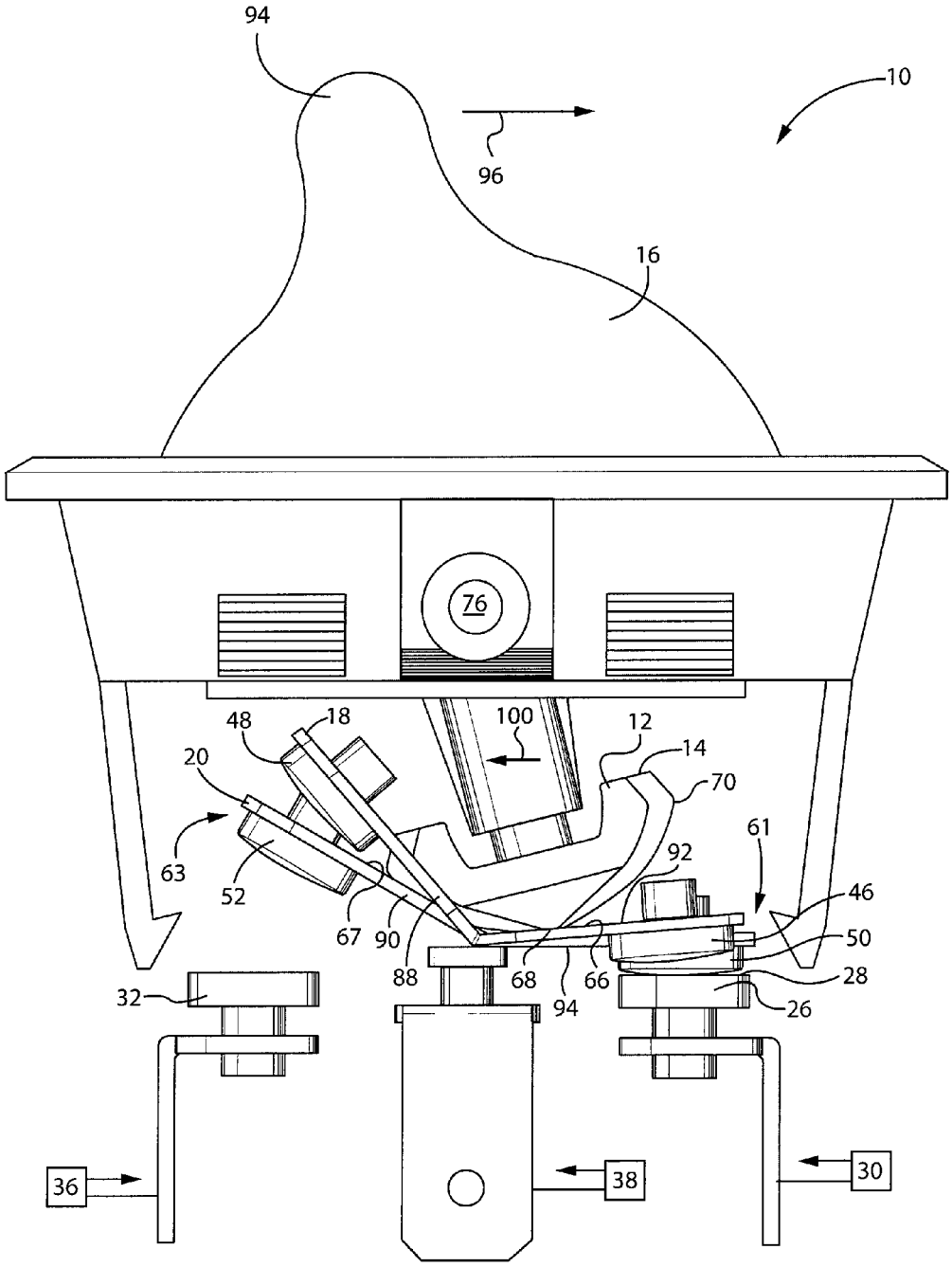
FIG. 4 depicts a view similar to FIG. 3 and shows the switch assembly moved partially away from the orientation shown in FIG. 3 wherein the load power conductor is no longer electrically connected to a power conductor associated with the first power source but the neutral load conductor remains electrically connected to the neutral conductor associated with the first power source.
Figure 5:
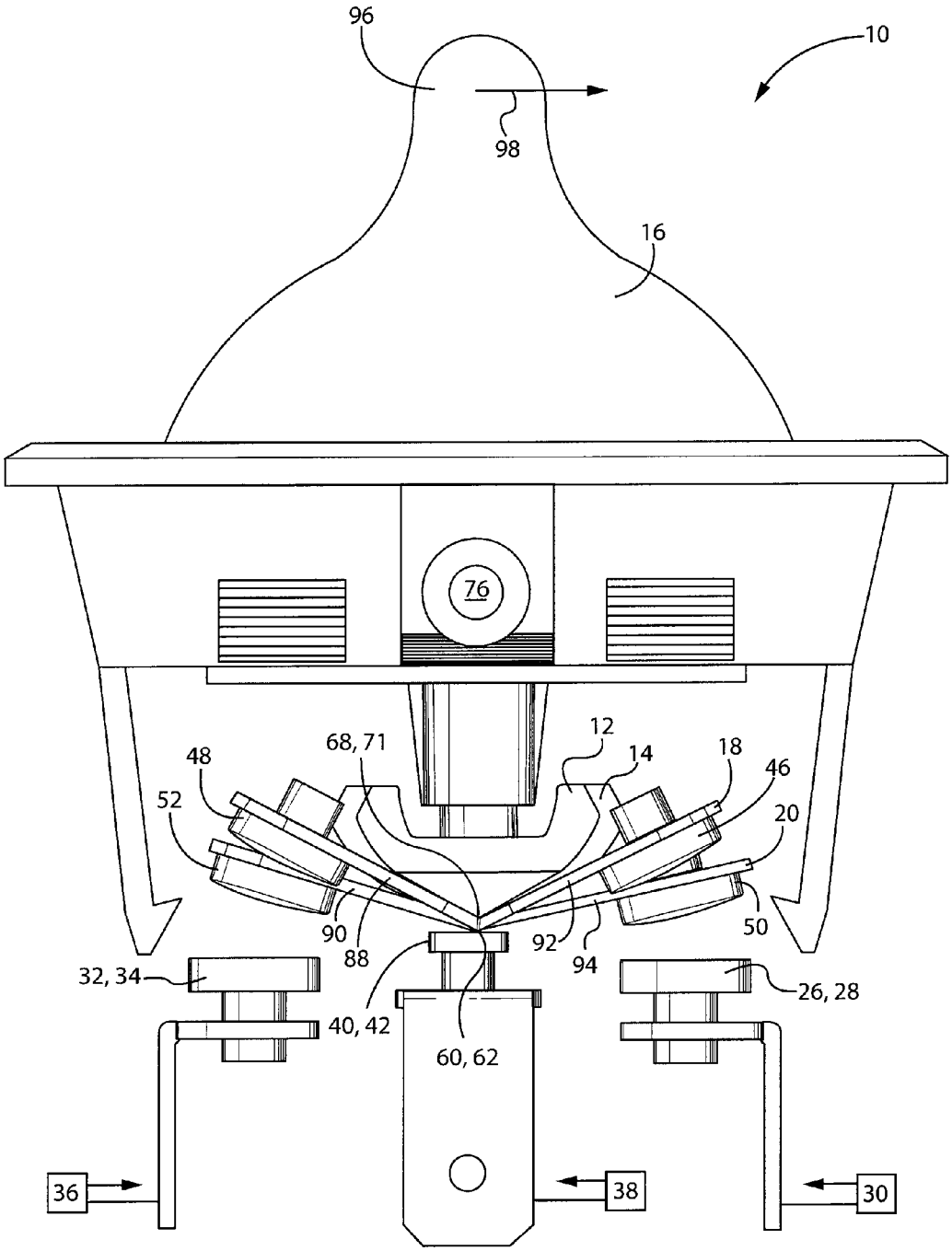
FIG. 5 depicts a view similar to FIG. 3 and shows the switch assembly in an intermediary configuration wherein the neutral and power conductors associated with a given load are electrically isolated from both the first and second power sources.
Figure 6:
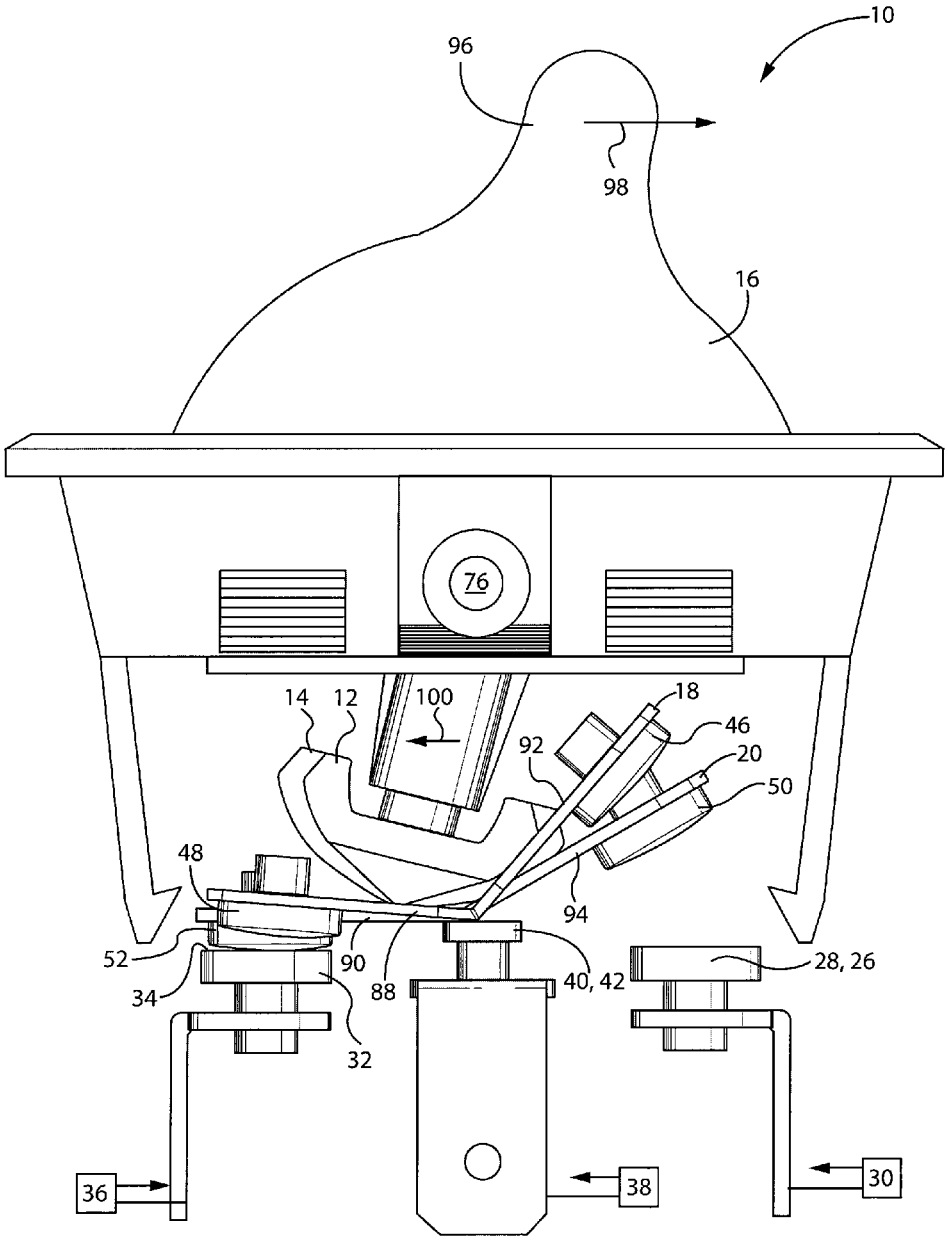
FIG. 6 depicts a view similar to FIG. 3 and shows the neutral conductor associated with a load electrically connected and the power conductor electrically isolated, respectively, from the second or alternate power source.
Figure 7:
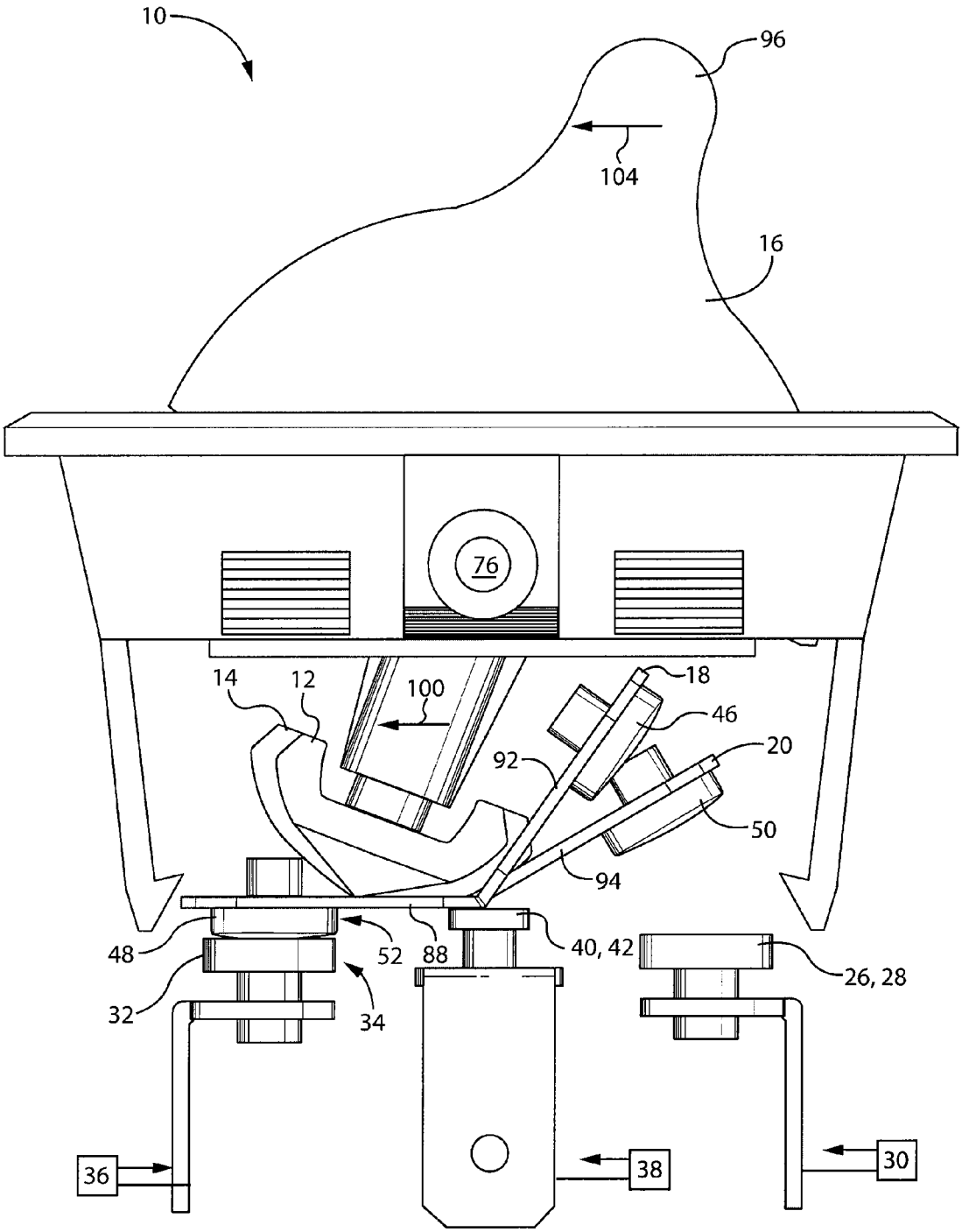
FIG. 7 depicts a view similar to FIG. 3 and shows the switch assembly in a second configuration in which the neutral and power conductors associated with a load electrically connected to the power and neutral conductors associated with an alternate power source, respectively, and electrically isolated from the first power source.

FIGS. 4-7 show various orientations of switch assembly 10 as handle 96 associated with actuator 16 moves from the first orientation or position (shown in FIG. 1-3) toward a second orientation or position (shown in FIG. 7). Referring to FIG. 4, partial rotation of actuator 16 via user interaction with handle 96 effectuates rotation of actuator 16 about pivot pin 76. Translation of handle 96 in switching direction 98 effectuates translation of movable elements 12, 14 in an alternate direction, indicated by arrow 100, relative to power conductor 18 and neutral conductor 20.

As shown in FIG. 4, partial translation of handle 96 translates apex 68 of movable element 12 along surface 66 of power conductor 18 and effectuates separation of fixed position power contact 26 and movable power contact 46 associated with power conductor 18. Still referring to the configuration shown in FIG. 4, neutral contact 50 remains briefly electrically engaged with fixed position neutral contact 28 associated with power source 30 after separation of power contacts 26, 46. As the operator rotates handle 96 away from the first position, movable elements 12, 14 move together so that a leading edge associated with movable elements 12, 14 contacts a portion of the respective power and neutral conductors 18, 20 that is toward an open switch side of the respective conductors 18, 20 and forces the power conductor 18 and the neutral conductor 20 to sequentially separate the electrical connections associated with contacts 26, 28 such that power conductor 18 is electrically isolated from contact 26 prior to neutral conductor 20 being electrically isolated from contact 28 associated with power source 30. That is, because neutral conductor 20 has a greater bend angle than power conductor 18, neutral contact 50 remains engaged with the neutral contact 28 for a longer period of time to enable breaking of the hot switch contacts 26, 46 prior to breaking the respective circuit neutral connection.

Referring to FIG. 5, continued translation of handle 96 in direction 98, relative to the orientation shown in FIG. 4, results in general alignment of apex 68 and apex 71 of movable elements 12 and 14 with the respective apex 60, 62 of the respective power conductor 18 and neutral conductor 20. In the intermediary switch position shown in FIG. 5, apexes 68, 71 of movable elements 12, 14 are generally aligned with apexes 60, 62 associated with the respective power and neutral conductors 18, 20 and generally align over the power and neutral contacts 40, 42 associated with load circuit 38. In the orientation shown in FIG. 5, switch assembly 10 is shown at a midway point of its travel between the first position of FIG. 3 and the second position shown in FIG. 7. At this midway point, movable element 14 associated with the neutral conductor 20 contacts the obtuse or second portion 90 of neutral conductor 20 such that movable element 14 biases neutral conductor in a direction that breaks the electrical connection between neutral contacts 28, 50 associated with power source 30. Such a configuration ensures that the neutral connection associated with neutral contacts 28, 50 is not broken until after the power or hot connection associated with power contacts 26, 46 is broken when moving actuator 16 from the first position toward the second position.

It should also be appreciated from the orientation shown in FIG. 5, that the neutral and power contacts 26, 28 associated with power source 30 and the neutral and power contacts 32, 34 associated with power source 36 are all electrically isolated from the power contacts 46, 48 associated with power conductor 18 and the neutral contacts 50, 52 associated with neutral conductor 20, respectively, when switch assembly 10 is at the intermediary switch location. Such a configuration electrically isolates load circuit 38 and power and neutral conductors 18, 20 of switch assembly 10 from both power sources 30, 36 simply via manipulation of actuator 16.

Referring to FIG. 6, continued translation of handle 96 in direction 98, relative to the orientation shown in FIG. 5, effectuates continued translation of first and second movable elements 12, 14 in direction 100 relative to power conductor 18 and neutral conductor 20. At the intermediary switch position shown in FIG. 6, it can be appreciated that neutral contact 52 associated with neutral conductor 20 is electrically connected to neutral contact 34 associated with alternate power source 36 while power contact 48 associated with power conductor 18 remains electrically isolated from power contact 32 associated with power source 36. Opposite to the positional orientation shown in FIG. 4, power contact 46 and neutral contact 50 associated with power conductor 18 and neutral conductor 20, respectively, remain electrically isolated from the neutral and power contact 26, 28 associated with power source 30 when switch assembly 10 is in the configuration shown in FIG. 6.

Still referring to FIG. 6, switch assembly 10 is shown moving past the midway point shown in FIG. 5 and toward the second position of actuator 16 as shown of FIG. 7. In the position shown in FIG. 6, the movable elements 12 and 14 are being forced toward a closed position by action of springs or similar such biasing associated with the interaction of movable elements 12, 14 with power and neutral conductors 18, 20. Such a bias can be provided by the geometric cooperation of movable elements 12, 14 with power and neutral conductors 18, 20 and the positional association of fixed position contacts 26, 28, 32, 34, 40, 42 and or via a compression spring provided between actuator 16 and movable elements 12, 14. In the latter configuration, it is appreciated that such a spring can be provided in the opening 22, 24 associated with the interaction of each or movable elements 12, 14 with actuator 16. It is appreciated that such a construction would provide a slidable interaction between movable elements 12, 14 and actuator 16, in a manner as is known.

As movable elements 12, 14 translate relative to conductors 18, 20 or rotate relative to pivot pin 76, cooperation of a trailing edge of movable element 12 with portion 92 of power conductor 18 prevents closure of power contacts 32, 40 associated with power conductor 18 and power source 36 until actuator 16 achieves the second position associated with FIG. 7. On the other hand, the more obtuse angle associated with movable element 12 and neutral conductor 20 allows neutral conductor 20 to move in a generally unobstructed manner to effectuate the electrical interaction of neutral contact 52 of neutral conductor 20 and neutral contact 34 associated with power source 36, such that an electrical connection between neutral contacts 34, 52 is established before an electrical connection between power contact 48 of power conductor 18 and contact 32 associated with power source 36. In this manner, switch assembly 10 prevents the occurrence of an open-neutral condition as discussed above.

FIG. 7 shows actuator 16 in a second position in which movable elements 12, 14 have been fully translated in direction 100 relative to power conductor 18 and neutral conductor 20 so as to bias movable power contact 48 into engagement with stationary power contact 32 associated with power source 36, after neutral contact 52 associated with neutral conductor 20 has been electrically connected to stationary neutral contact 34 associated with power source 36. This second position of actuator 16 also maintains the electrical separation between movable power contact 46 and movable neutral contact 50 associated with power conductor 18 and neutral conductor 20, respectively, with the respect to stationary power and neutral contacts 26, 28 associated with power source 30.

In the configuration shown in FIG. 7, power conductor 18 and neutral conductor 20 electrically connect power contact 32 and neutral contact 34 associated with power source 36 with the respective power contact 40 and neutral contact 42 associated with load 38 via power and neutral conductors 18, 20, respectively. From the position shown in FIG. 7, actuator 16 is movable in an opposite direction, indicated by arrow 104, relative to direction 98 (FIGS. 3-6) to effectuate an opposite sequencing of the switching of the conducting state of movable power conductor 18 and movable neutral conductor 20 for returning load contacts 40, 42 to an electrically conductive configuration with contacts 26, 28 of power source 30 when so desired.

Similar to the description provided above with respect to FIG. 3, when in the second position as shown in FIG. 7, portion 94 of neutral conductor 20 is positioned at an angle relative to horizontal that is less than the angle of portion 92 of power conductor 18. Arranging the respective portions 88, 90, 92, 94 of the neutral and power conductors 18, 20 in such a manner allows switch assembly 10 to return load 38 to a conducting arrangement with power source 30 when so desired via manipulation of actuator 16 in opposite direction 104 and allows a similar sequencing of the making and breaking of the neutral and power connections with the respective power sources 30, 36 and the respective circuit associated with a particular load 38. That is, switch assembly 10 is configured such that, for example, when switching from primary or utility power to a secondary, auxiliary, or generator power, the main power is first switched "OFF", then the main neutral is switched "OFF", then the generator neutral is switched "ON" and finally the generator power is switched "ON". Understandably, when switching from the generator or secondary power to the main or primary power, this sequence is reversed. In this way, switch assembly 10 is configured to avoid open neutral conditions by virtue of the configurations of movable elements 12, 14 and their respective cooperation with power and neutral conductors 18, 20 and requires but a single action on the part of the operator to ensure a proper disconnect and connect sequencing regardless of the switching direction between first and second power sources such as utility and auxiliary power sources.

When actuator 16 is positioned in one of the first and second positions, the angles of the disengaged portions, i.e., portions 88, 90 in FIG. 3 and portions 92, 94 in FIG. 7, are arranged at disparate angles relative to horizontal defined by an upper surface of the respective stationary power and neutral contacts 26, 28, 32, 34, 40, 42. In particular, when in the first position shown in FIG. 3, portions 90, 94 of neutral conductor 20 are arranged at angles relative to horizontal that is less than an angle of the portions 88, 90 of power conductor 18 relative to horizontal. Said in another way, the angle between portions 90, 94 associated with neutral conductor 20 is greater than or more obtuse than the corresponding angle between portions 88, 92 of power conductor 18. For example, the angle between the portions 88, 92 of power conductor 18 may be on the order of approximately 125 degrees while the angle between the portions 90, 94 associated with neutral conductor 20 may be on the order of approximately 150 degrees. Of course, other angular relationships may be utilized in keeping with the present invention.

As described above, switch assembly 10 includes an actuator 16 that is selectively engageable by an operator for moving the actuator 16 between a first position (FIG. 3) and a second position (FIG. 7). In the first position, the switch assembly 10 operably electrically connects a circuit associated with a load 38 to a main or utility power source 30, while in the second position the switch assembly 10 operably electrically couples the load 38 with an auxiliary power source 36. It is appreciated that actuator 16 may be in the form of a standard paddle-type actuator of the kind generally known in the art. The actuator 16 is pivotable relative to a housing, such as housing 78, for moving the first and second movable elements 12 and 14 relative to the pivotable or movable conductors 18, 20 as described above to effectuate the desired isolated electrical switching of the circuit associated with load 38 for electrical connection with a respective desired power source 30, 36.

As such, switch assembly 10 provides a switch configuration in which the neutral and power connections associated with a particular load can be electrically connected to alternate power sources in a manner that avoids an open neutral condition, that allows making and breaking the neutral connections before and after, respectively, the making and breaking of the power or hot electrical connections associated with either of the respective power sources, and does so in a manner that only requires user interaction with a single actuator or user movable member of the switch assembly.

Various embodiments are described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

I claim:

1. A switch assembly comprising:

an actuator movable between a first position and a second position;

a first movable element and a second movable element operably coupled to one another and the actuator;

a positive switch contact arrangement coupled with the first movable element;

a neutral switch contact arrangement coupled with the second movable element; and wherein the positive switch contact arrangement and the neutral switch contact arrangement comprise geometrically different constructions so that when moving the actuator between a first position and a second position, the switch assembly avoids an open neutral condition in which the positive switch contact arrangement is engaged without the neutral switch contact arrangement being engaged, wherein the positive switch contact arrangement and the neutral switch contact arrangement comprise respective conductive supports including a first portion and a second portion, wherein the respective first portions and the second portions carry a contact switch element that is selectively engageable with a corresponding respective contact element for selectively coupling a respective contact switch element of each of the positive switch contact arrangement and the neutral switch contact arrangement with a first power source and a second power source, wherein the first portion and the second portion of the positive switch contact arrangement and the neutral switch contact each define an obtuse angle therebetween, and wherein the obtuse angle defined by the neutral switch contact arrangement is greater than the obtuse angle of the positive switch contact arrangement.

2. A switch assembly comprising:

an actuator movable between a first position and a second position;

a first movable element and a second movable element operably coupled to the actuator;

a positive switch conductor engaged with the first movable element, wherein the positive switch conductor is selectively engagable with a first positive contact when the actuator is in the first position and with a second positive contact when the actuator is in the second position;

a neutral switch conductor engaged with the second movable element, wherein the neutral switch conductor is selectively engageable with a first neutral contact when the actuator is in the first position and with a second neutral contact when the actuator is in the second position; and wherein the first and second movable elements, the positive switch conductor and the neutral switch conductor comprise geometrically different constructions so that when moving the actuator between the first position and the second position, the switch assembly avoids an open neutral condition in which the positive switch conductor is engaged with the first positive contact without the neutral switch conductor being engaged with the first neutral contact or in which the positive switch conductor is engaged with the second positive contact without the neutral switch conductor being engaged with the second neutral contact.

3. The switch assembly of claim 2, wherein the first positive contact and the second positive contact selectively connect the positive conductor to one of a utility power source and a secondary power source.

4. The switch assembly of claim 1, wherein the first neutral contact and the second neutral contact selectively connect the neutral conductor to one of a utility power source and a secondary power source.

5. The switch assembly of claim 2, wherein the actuator is operably coupled with the first movable element and the second movable element so that movement of the actuator between the first position and the second position moves the first movable element and the second movable element in a predetermined sequence.

6. The switch assembly of claim 5 further comprising a housing that pivotably supports the actuator relative to the positive switch conductor and the neutral switch conductor.

7. The switch assembly of claim 6, wherein the housing further comprises at least one tang shaped to define a position of a pivot relative to the positive switch conductor and the neutral switch conductor.

8. The switch assembly of claim 2, wherein the positive switch conductor and the neutral switch conductor comprise respective first and second portions, wherein the first portion and the second portion of the positive switch conductor and the neutral switch conductor each define an obtuse angle therebetween, and wherein the obtuse angle defined by the neutral switch conductor is greater than the obtuse angle defined by the positive switch conductor.

9. A switch assembly comprising:

a first neutral contact and a second neutral contact;

a first power contact and a second power contact;

a neutral conductor that is movable between a first position wherein the neutral conductor is electrically connected to the first neutral contact and is electrically isolated from the second neutral contact and a second position wherein the neutral conductor is electrically connected to the second neutral contact and is electrically isolated from the first neutral contact;

a power conductor that is movable between a first position wherein the power conductor is electrically connected to the first power contact and is electrically isolated from the second power contact and a second position wherein the power conductor is electrically connected to the second power contact and is electrically isolated from the second power contact; and a single actuator that effectuates sequential movement of the neutral conductor and the power conductor between their respective first and second positions such that the neutral conductor remains in the neutral conductor first position after the power conductor moves from the power conductor first position and arrives at the neutral conductor second position before the power conductor arrives at the power conductor second position.

10. The switch assembly of claim 9 further comprising a third neutral contact that is electrically connected to the neutral conductor when the neutral conductor is at or between the first and second positions of the neutral conductor.

11. The switch assembly of claim 10 further comprising a third power contact that is electrically connected to the power conductor when the neutral conductor is at or between the first and second positions of the power conductor.

12. The switch assembly of claim 11 further comprising a control arrangement that is attached to the single actuator, the control arrangement including a first portion that is associated with movement of the neutral conductor and a second portion that is associated with movement of the power conductor between their respective first and second positions.

13. The switch assembly of claim 12 wherein the first portion and the second portion of the control arrangement each include sections that are oriented at obtuse angles relative to one another and the obtuse angle associated with the first portion of the control arrangement is greater than the obtuse angle associated with the second portion of the control arrangement.

14. The switch assembly of claim 11 further comprising a control arrangement that is attached to the single actuator and which defines an apex that is movable between alternate lateral sides of the third neutral contact and the third power contact.

15. The switch assembly of claim 14 wherein the neutral conductor is electrically isolated from both the first neutral contact and the second neutral contact and the power conductor is electrically isolated from both the first power contact and the second power contact when the apex is aligned with the first neutral contact and the third power contact.

16. A method of switching a load between a first power source and a second power source, the method comprising:

providing an actuator having a first portion and a second portion;

wherein a first portion of the actuator is configured for cooperating with a power conductor that is selectively electrically connectable to one of a first power contact and a second power contact and is not electrically isolatable from a third power contact;

wherein a second portion of the actuator is configured for cooperating with a neutral conductor that is selectively electrically connectable to one of a first neutral contact and a second neutral contact and is not electrically isolatable from a third neutral contact; and positionally associating the actuator relative to the power conductor and the neutral conductor so that movement of the actuator from a first position to a second position:

1) electrically isolates the neutral conductor from each of the first neutral contact and the second neutral contact before the power conductor is electrically isolated from a respective one of the first power contact and the second power contact; and 2) electrically connects the neutral conductor to one of the first neutral contact and the second neutral contact before the power conductor is electrically connected to the other respective one of the first power contact and the second power contact.

17. The method of claim 16 further comprising pivotably supporting the actuator in a housing so that a user end extends in a direction opposite the first and second portions relative to a pivot axis.

18. The method of claim 16 wherein the first portion of the actuator and the second portion of the actuator are configured such that the first portion occupies a smaller footprint than the second portion relative to a direction that is transverse to a plane of movement of the actuator.

19. The method of claim 18 further comprising forming an apex on the first portion and an apex on the second portion that are each aligned with a respective one of the third power contact and the third neutral contact when the actuator is between the first and second positions.

20. The method of claim 18 further comprising electrically isolating the neutral conductor from the first neutral contact and the second neutral contact when the second portion of the actuator overlaps the third neutral contact and electrically isolating the power conductor from the first power contact and the second power contact when the first portion of the actuator overlaps the third power contact.

21. The method of claim 16 further comprising bending the power conductor and the neutral conductor at different angles relative to one another and at different angles relative to the respective first portion and second portion of the actuator.

* * * * *